US012433465B2

(12) United States Patent
VanTongeren et al.

(10) Patent No.: US 12,433,465 B2
(45) Date of Patent: Oct. 7, 2025

(54) DOCKING STATION FOR AN AUTONOMOUS FLOOR CLEANER

(71) Applicant: BISSELL Inc., Grand Rapids, MI (US)

(72) Inventors: Todd R. VanTongeren, Ada, MI (US); Andrew J. Brouwers, Grand Rapids, MI (US); Justin Nguyen, Wyoming, MI (US); Daniel A Schurr, Wyoming, MI (US)

(73) Assignee: BISSELL Inc., Grand Rapids, MI (US)

( * ) Notice: Subject to any disclaimer, the term of this patent is extended or adjusted under 35 U.S.C. 154(b) by 118 days.

(21) Appl. No.: 18/527,507

(22) Filed: Dec. 4, 2023

(65) Prior Publication Data

US 2024/0197131 A1 Jun. 20, 2024

Related U.S. Application Data

(60) Provisional application No. 63/432,769, filed on Dec. 15, 2022.

(51) Int. Cl.
*A47L 11/29* (2006.01)

(52) U.S. Cl.
CPC ..... *A47L 11/29* (2013.01); *A47L 2201/022* (2013.01); *A47L 2201/024* (2013.01); *A47L 2201/026* (2013.01)

(58) Field of Classification Search
CPC ..... A47L 11/4016; A47L 11/29; A47L 2201/022; A47L 2201/024; A47L 2201/026
USPC ..... 141/98
See application file for complete search history.

(56) References Cited

U.S. PATENT DOCUMENTS

| | | | | |
|---|---|---|---|---|
| 7,891,387 | B2 | 2/2011 | Lim et al. | |
| 2016/0331202 | A1 | 11/2016 | Arakawa | |
| 2019/0069748 | A1* | 3/2019 | Blumhardt | A47L 11/4019 |
| 2021/0290025 | A1* | 9/2021 | Finison | A47L 11/4005 |
| 2021/0330166 | A1 | 10/2021 | Wu et al. | |
| 2022/0061612 | A1 | 3/2022 | Wolff et al. | |
| 2022/0400925 | A1* | 12/2022 | Hoobler | A47L 11/28 |

FOREIGN PATENT DOCUMENTS

| | | | |
|---|---|---|---|
| CN | 106725135 | A | 5/2017 |
| CN | 112006614 | A | 7/2020 |
| CN | 112006615 | A | 7/2020 |
| CN | 112006618 | A | 7/2020 |
| CN | 111938526 | A | 8/2020 |
| CN | 211749314 | U | 10/2020 |
| DE | 202016104066 | U1 | 10/2017 |

(Continued)

*Primary Examiner* — Kenneth Rinehart
*Assistant Examiner* — Christopher M Afful
(74) *Attorney, Agent, or Firm* — Warner Norcross + Judd LLP

(57) ABSTRACT

An autonomous floor cleaning system includes an autonomous floor cleaner with a docking station. The docking station is configured to performing maintenance for the autonomous floor cleaner, such as refilling the autonomous floor cleaner, emptying the autonomous floor cleaner, washing mopping pads, and/or recharging the autonomous floor cleaner. The docking system can supply heated cleaning fluid to the autonomous floor cleaner. Methods for servicing or performing maintenance on an autonomous floor cleaner by a docking station are disclosed.

20 Claims, 5 Drawing Sheets

(56) References Cited

FOREIGN PATENT DOCUMENTS

| | | | |
|---|---|---|---|
| DE | 102016115320 | A1 | 2/2018 |
| EP | 3366180 | A1 | 8/2018 |
| WO | 2018108144 | A1 | 6/2018 |
| WO | 2022133174 | A2 | 6/2022 |

* cited by examiner

DOCKING STATION FOR AN AUTONOMOUS FLOOR CLEANER

CROSS-REFERENCE TO RELATED APPLICATION(S)

This application claims the benefit of U.S. Provisional Patent Application No. 63/432,769, filed Dec. 15, 2022, which is incorporated by reference herein in its entirety.

BACKGROUND

Autonomous or robotic floor cleaners can move without the assistance of a user or operator to clean a floor. Many autonomous floor cleaners need to return to a docking station to recharge their battery. Docking stations are evolving to become multifunction docking stations that incorporate a number of different features. In order to further automate the cleaning process, some docking stations have been adapted to empty and/or refill the robot so that human intervention is reduced. However, autonomous floor cleaners adapted for wet cleaning, i.e. robots that dispense cleaning fluid, typically still require frequent intervention and servicing by a human user to maintain the wet cleaning robots. Such efforts are time-consuming and defeat the purpose of an autonomous cleaner.

Therefore, there still exists a need for an automatous cleaning system that reduces the frequency of intervention and servicing by a human user.

BRIEF SUMMARY

The disclosure relates to a docking station for an autonomous floor cleaner. Various methods for docking an autonomous floor cleaner with a docking station are described herein.

In one aspect of the disclosure, a docking station for an autonomous floor cleaner includes a refilling system for refilling a supply tank on a robot, wherein the refilling system includes a heater to heat cleaning fluid supplied to the robot.

In another aspect of the disclosure, a docking station for an autonomous floor cleaner includes a storage tank, a dispensing port configured to couple with a first port on the autonomous floor cleaner to refill a supply tank on the autonomous floor cleaner with cleaning fluid from the storage tank, a discharge path configured to convey cleaning fluid from the storage tank to the dispensing port, a pump to move cleaning fluid through the discharge path, a heater to heat cleaning fluid in the discharge path, a recirculation chamber in the discharge path, the recirculation chamber having an outlet in fluid communication with a discharge path configured to convey cleaning fluid from the storage tank to the dispensing port, and a recirculation port configured to couple with a second port on the autonomous floor cleaner to circulate cleaning fluid from the supply tank on the autonomous floor cleaner to the recirculation chamber.

In yet another aspect of the disclosure, a docking station for an autonomous floor cleaner includes at least two charging contacts configured to charge a battery of the autonomous floor cleaner, a storage tank, a discharge path configured to convey cleaning fluid from the storage tank to the autonomous floor cleaner, a dispensing port configured to couple with a first port on the autonomous floor cleaner to refill a supply tank on the autonomous floor cleaner with cleaning fluid from the storage tank, a recirculation path configured to convey cleaning fluid from the autonomous floor cleaner to the discharge path, a recirculation port configured to couple with a second port on the autonomous floor cleaner to circulate cleaning fluid from the supply tank on the autonomous floor cleaner to the recirculation path, and an indexer carrying the dispensing port and the recirculation port, and configured to move the ports into and out of engagement with the autonomous floor cleaner.

In a further aspect of the disclosure, a method for serving an autonomous floor cleaner includes refilling a supply tank of the autonomous floor cleaner with heated cleaning fluid at the docking station.

In still a further aspect of the disclosure, a method for serving an autonomous floor cleaner includes docking the autonomous floor cleaner at a docking station, the docking station having a storage tank configured to hold a supply of cleaning fluid, a dispensing port, a heater, and a discharge path configured to convey liquid from the storage tank to the dispensing port, coupling a supply tank on the autonomous floor cleaner to the dispensing port of the docking station, and exchanging cooled cleaning fluid in the supply tank with heated cleaning fluid from the docking station by recirculating cooled cleaning fluid in the supply tank on the autonomous floor cleaner to the docking station.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to the docking of autonomous floor cleaners with docking stations. More specifically, the disclosure relates to docking stations for wet cleaning robots and the servicing of wet cleaning robots.

Figure 1:
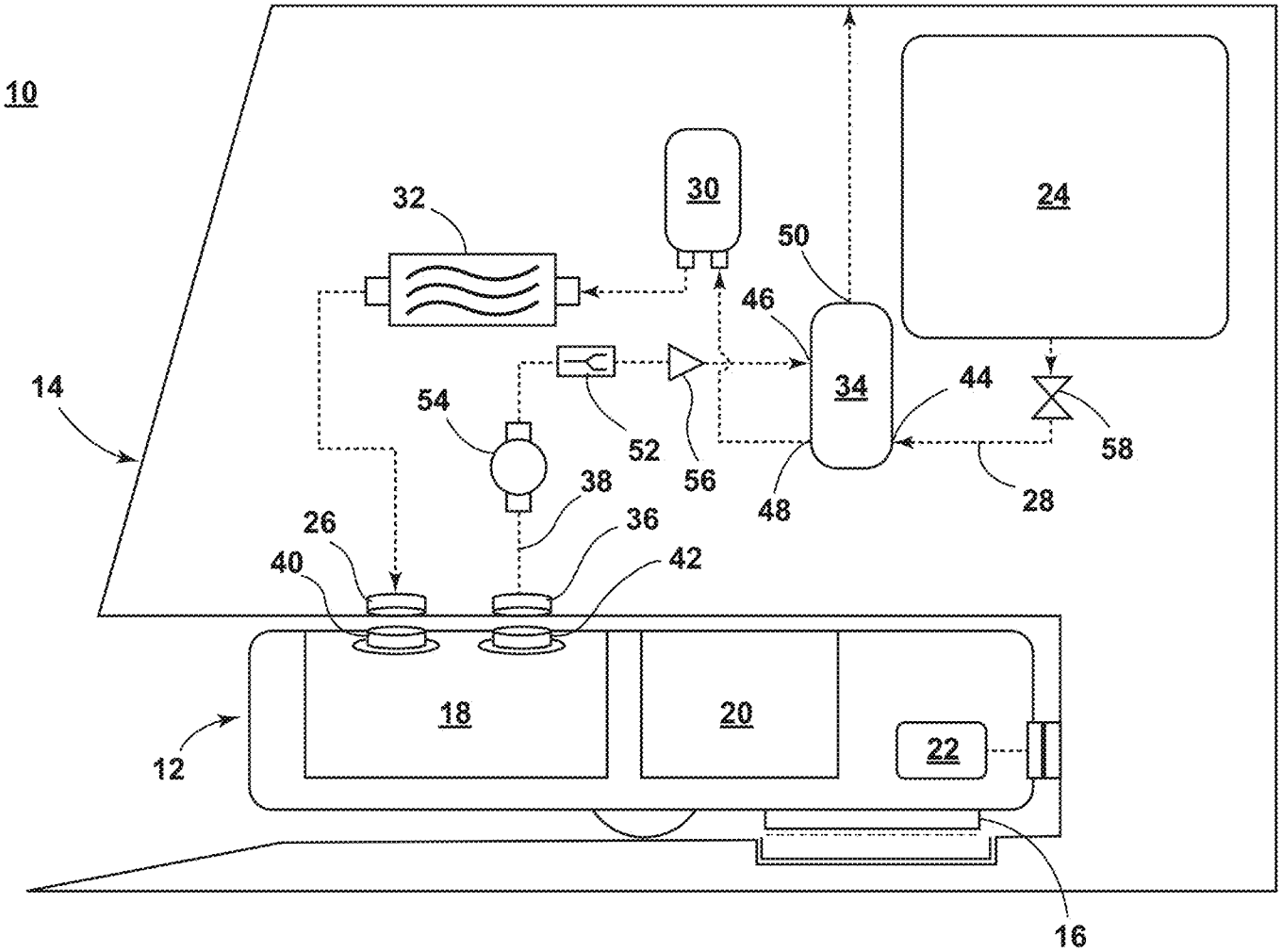
FIG. 1 is a schematic view of a floor cleaning system according to one aspect of the disclosure, the system including at least a floor cleaner and a docking station.

FIG. 1 is a schematic view of an autonomous floor cleaning system 10 according to one embodiment of the invention. The autonomous floor cleaning system 10 includes an autonomous floor cleaner 12 and a docking station 14 for the autonomous floor cleaner 12, also referred to herein as a robot. The robot 12 can clean various floor surfaces, including bare floors such as hardwood, tile, and stone, and soft surfaces such as carpets and rugs. Optionally, the system 10 can include an artificial barrier system (not shown) for containing the robot 12 within a user-determined boundary.

The robot 12 is dockable with the docking station 14 for recharging of the robot 12. Additionally, the robot 12 is dockable with the docking station 14 for servicing of the robot 12, e.g. performing maintenance, in tandem with or separately from recharging the robot 12, thereby greatly extending the time between interventions by a human user Some non-limiting examples of service functions that the docking station 14 can perform on the robot 12 include refilling a supply tank 18 of the robot 12, recirculating cleaning fluid between the robot 12 and docking station 14, emptying a collection bin 20 of the robot 12, cleaning an agitating element 16 of the robot 12, removing and/or installing an agitating element 16 of the robot 12, recharging a battery 22 of the robot 12, or any combination of these service functions.

In one embodiment, the robot 12 is a wet mopping and sweeping robot including a fluid delivery system for storing cleaning fluid and delivering the cleaning fluid to the surface to be cleaned, a mopping system for removing cleaning fluid and debris from the surface to be cleaned via absorption by the mopping pads 16, and a sweeping system for collecting cleaning fluid and debris from the surface to be cleaned without the use of suction. The fluid delivery system may be configured to delivery liquid, steam, mist, or vapor to the surface to be cleaned.

In another embodiment, the robot 12 can be a wet mopping robot including a fluid delivery system and a mopping system, without the sweeping system.

In yet another embodiment, the robot 12 can be a deep cleaning robot including a fluid delivery system, a mopping system, and a recovery system for removing liquid and/or debris from the surface to be cleaned and storing the recovered cleaning liquid and/or debris. The recovery system can include a suction source for creating a partial vacuum to suck up liquid and/or debris from the surface.

In still another embodiment, the robot 12 can be a cleaning robot including a recovery system, without a fluid delivery system or a mopping system.

The docking station 14 can be configured to dock, recharge, and service any of the aforementioned robot types. The docking station 14 can include a housing configured to dock the autonomous floor cleaner.

All of the aforementioned robot types mounts the components of various functional systems of the autonomous floor cleaner in an autonomously moveable unit or housing, and may include a drive system and a navigation/mapping system. A controller is operably coupled with the various functional systems of the robot 12 for controlling the operation of the robot 12. One example of a robot 12 is disclosed in International Publication No. WO2022133174, published Jun. 23, 2022, and hereby incorporated by reference in its entirety.

As used herein, the term "debris" includes dirt, dust, soil, hair, and other debris, unless otherwise noted. As used herein, the term "cleaning fluid" as used herein primarily encompasses liquids, and may include steam unless otherwise noted. Such liquids may include, but are not limited to, water or solutions containing water (like water mixed with a cleaning chemistry, fragrance, etc.).

In one aspect of the disclosure, the robot 12 can be docked with the docking station 14, and the docking station 14 can automatically refill the supply tank 18 with cleaning fluid. The docking station 14 can have a refilling system that can heat the cleaning fluid supplied to the robot 12 and/or recirculate cleaning fluid with the robot 12, as described in further detail below. The supply tank 18 may be adapted to hold supply of liquid to be used during a cleaning operation, e.g., dispensed on the surface to be cleaned as a liquid, steam, mist, vapor, or mixture thereof.

The refilling system for the docking station 14 can include a storage tank 24 configured to hold a supply of cleaning fluid, a supply port 26 configured to couple with the supply tank 18 on the robot 12, and a discharge path 28 configured to convey cleaning fluid from the storage tank 24 to the supply port 26.

The refilling system can include a pump 30 to move fluid through the discharge path 28 when the pump 30 is activated. In one embodiment, the pump 30 can be a through-flow pump in the discharge path 28 between the storage tank 24 and the supply port 26.

The refilling system can include a heater 32 to heat the cleaning fluid before it is supplied to the robot's supply tank 18. In one embodiment, the heater 32 can be an in-line fluid heater between the storage tank 24 and the supply port 26, or a heater in proximity to the discharge path 28. The heater 32 can, for example, be positioned in the discharge path 28 downstream of the pump 30 and upstream of the supply port 26. The heater 32 may preferably heat the cleaning fluid to about 37 to 100° C., alternatively about 60 to 80° C., where "about" includes ±10° C.

In one aspect of the disclosure, the refilling system is configured to recirculate unused cleaning fluid from the supply tank 18 on robot 12 back to the docking station 14 in order to resupply the robot 12 with heated cleaning fluid. Therefore, rather than operating by filling the robot 12 to a predetermined level, the docking station 14 may operate by filling the robot 12 while recirculating cleaning fluid between the robot 12 and docking station 14 until the robot 12 is filled with a supply of cleaning fluid having a predetermined temperature. In being "unused," the cleaning fluid that is recirculated back to the docking station 14 has not been dispensed from the robot 12 or otherwise used for cleaning. Unused cleaning fluid may also be referred to herein in some aspects as cooled cleaning fluid.

Heated cleaning fluid is useful for cleaning, as adding heat may help enhance the efficacy of the cleaning fluid. Overtime, cleaning fluid in the supply tank 18 may cool, and become less useful for cleaning. Providing a docking station 14 that supplies the robot 12 with heated cleaning fluid, and which can recycle cooled cleaning fluid back to the docking station for re-heating, reduces the frequency of intervention and servicing needed by a human user, while maintaining a high level of cleaning efficacy of the robot 12. This also avoids the need for a heater on the robot 12, which conserves valuable space on the robot 12 and avoids having to power another component with the battery 22. The weight of robot 12 may also be reduced, as less insulation may be required around the supply tank 18. However, it is understood that the docking station 14 described herein may be useful even to robots with onboard heaters and/or heat-insulated supply tanks.

The refilling system can include a recirculation chamber 34 in the discharge path 28 and a recirculation port 36 configured to couple with the supply tank 18 on the robot 12. A recirculation path 38 conveys cleaning fluid from the recirculation port 36 to the recirculation chamber 34. The recirculation chamber 34 can be fluidly upstream of the heater 32, such that the cleaning fluid is circulated back to the discharge path 28 at a location upstream of the heater 32, and such that the cleaning fluid is heated by the heater 32 as it circulates back to the robot 12. The pump 30 is configured to pressurize both the discharge path 28 and the recirculation path 38.

The recirculation chamber 34 helps air escape the recirculation path 38. Accordingly, the recirculation chamber 34 is sized to accommodate both recirculating liquid and air. A volume of space for air in the recirculation chamber 34 allows any air returning from the supply tank 18 on the robot 12 to be separated from the liquid, so that the air is not recirculated through the docking station 14 over and over. As described in further detail below, the chamber 34 is configured to allow the air to escape the system, so that only liquid is sent through the heater and into the robot's supply tank 18. In one non-limiting example, the recirculation chamber 34 has a volume of about 50 to about 250 ml, alternatively about 120 ml.

The supply port 26 can couple with a first or supply port 40 on the robot 12 to supply the supply tank 18 with heated cleaning fluid. Cleaning fluid in the discharge path 28 may exit through the supply port 26 and be conveyed through the first port 40 to the supply tank 18.

The recirculation port 36 can couple with a second or recirculation port 42 on the robot 12 to circulate unused cleaning fluid from the supply tank 18 to the recirculation chamber 34. Cleaning fluid in the supply tank 18 may exit through the second port 42 and be conveyed through the recirculation port 36 to the recirculation chamber 34.

When the robot 12 docks with the docking station 14, a first fluid connection can be established between supply ports 26, 40 and a second fluid connection can be established between the recirculation ports 36, 42. These connections can be made automatically, e.g. without user intervention. In some embodiments, the connections may be passively made between the docking station 14 and robot 12, such as during the driving action of the robot 12 onto the docking station 14. In other embodiments, the connections may be actively made, such by using motors, solenoids, and the like, to move at least one, and optionally multiple, of the ports 26, 36, 40, 42 into engagement. The docking station 14 can include features that assist in alignment of the supply port 26 with the first port 40, and of the recirculation port 36 with the second port 42, either through mechanical or electrical means.

Any of the ports 26, 36, 40, 42 can comprise a valve to control the flow of cleaning fluid therethrough, e.g., out of or into said port. Such valves can prevent, for example, the flow of cleaning fluid before a fluid connection is established between ports, including when the robot 12 is not docked with the docking station 14, and/or when the docking station 14 is not refilling the robot 12. The valves can be configured to open automatically when the fluid connection is established and/or when the robot 12 requires refilling. In one example, the valves can be mechanically operated and may open by the physical coupling of the supply ports 26, 40 or the recirculation ports 36, 42.

In the embodiment shown, cleaning fluid dispensed from the storage tank 24 passes through the recirculation chamber 34. Cleaning fluid recirculated from the robot 12 also passes through the recirculation chamber 34 to mix with the cleaning fluid dispensed from the storage tank 24. The recirculation chamber 34 comprises a first inlet 44 in fluid communication with the storage tank 24 and a second inlet 46 in fluid communication with the recirculation port 36 via the recirculation path 38.

The recirculation chamber 34 can have a cleaning fluid outlet 48 in fluid communication with the heater 32, such that the cleaning fluid is circulated back to the discharge path 28 at a location upstream of the heater 32, and such that the cleaning fluid is heated by the heater 32 as it circulates back to the robot 12. Preferably the chamber 34 as a single fluid outlet 48, such that cleaning fluid received though either inlet 44, 46 exits the chamber 34 through a common outlet 48.

The second inlet 46 is preferably higher than the first inlet 44 and the outlet 48. This encourages liquid that is recirculated to the chamber 34 to fall down to the bottom of the chamber 34 and mix with fresh liquid being drawn through the discharge path 28 by the pump 30. The first inlet 44 and outlet 48 may be at substantially the same height. Alternatively, the first inlet 44 can be higher than the outlet 48.

The recirculation chamber 34 can have an air escape outlet 50 in fluid communication with ambient air, e.g., with the environment outside the docking station 14. The air escape outlet 50 can be in direct fluid communication with ambient air, or may be in fluid communication with a vent on the docking station 14 for venting air outside the docking station 14. Preferably, the air escape outlet 50 is disposed higher than a maximum water level of the chamber 34 to prevent overflow.

During operation, air may be introduced by the circulation of air and cleaning fluid in the robot's supply tank 18 into the docking station 14. Without releasing this air from the system, the air may be sent back into the supply tank 18, thereby extending the time to refill the tank 18 and/or forming bubbles in the recirculation system and/or tank 18. The recirculation chamber 34 can control the exit of air via the outlet 50.

The refilling system can include a temperature sensor 52 configured to infer the temperature of cleaning fluid in the supply tank 18 on the robot 12. Aside from this function, the temperature sensor 52 is not particularly limited, and may comprise any components and/or configurations suitable for use in/as a temperature sensor. The temperature sensor 52 can, for example be a thermistor.

The temperature sensor 52 may be located in the recirculation path 38, or in another location suitable to sense the temperature of cleaning fluid circulated from the supply tank 18 to the recirculation chamber 34, such as, but not limited to, at the recirculation port 36 or at the second inlet 46 to the recirculation chamber 34. In another embodiment, the temperature sensor 52 may be located the robot 12, including, but not limited to, being located in the supply tank 18.

Input from the temperature sensor 52 can be used to control the docking station 14 and/or the robot 12. For example, the temperature sensor 52 can detect when the temperature of cleaning fluid in the supply tank 18 is at or exceeds a predetermined temperature threshold, and send a signal to the docking station 14 and/or the robot 12 that controls the refilling process. The temperature threshold may be 37 to 100° C., alternatively 60 to 80° C. One non-limiting example of a predetermined temperature threshold for cleaning fluid in the supply tank 18 is 74° C.

By sensing or inferring the temperature of cleaning fluid in the supply tank 18, the aspects of the refilling system can be controlled. Temperature sensor input may be used, for example, to end the refilling process, deactivate the pump 30, deactivate the heater 32, close one more valves of the refilling system, uncouple the supply ports 26, 40, uncouple the recirculation ports 36, 42, or any combination thereof. Temperature sensor input may also be used, for example to undock the robot 12 from the docking station 14, provide a user notification to a human user, or any combination thereof.

Optionally, the refilling system can include a fluid sensor 54 in the recirculation path 38 configured to detect the presence and/or absence of cleaning fluid in the recirculation path 38. Aside from this function, the fluid sensor 54 is not particularly limited, and may comprise any components and/or configurations suitable for use in/as a fluid sensor. The fluid sensor 54 can, for example be a flow meter or a resistive liquid presence sensor. The fluid sensor 54 may be located in the recirculation path 38, or in another location suitable to sense the presence and/or absence of cleaning fluid circulated from the supply tank 18 to the recirculation chamber 34, such as, but not limited to, at the recirculation port 36 or at the second inlet 46 to the recirculation chamber 34. In another embodiment, the fluid sensor 54 may be located the robot 12, including, but not limited to, being located at the recirculation port 42 of the supply tank 18.

Input from the fluid sensor 54 can be used to control the docking station 14 and/or the robot 12. For example, the fluid sensor 54 can detect when there is cleaning fluid in the recirculation path 38, and send a signal to the docking station 14 that controls the refilling process. By sensing cleaning fluid in the recirculation path 38, the docking station 14 can infer that the temperature sensed by the temperature sensor 52 is that of cleaning fluid exiting the supply tank 18, rather than that of air exiting the supply tank 18. Fluid sensor input may be used, for example, to take a temperature sensor reading, evaluate a temperature sensor reading, compare a temperature sensor reading to a predetermined temperature threshold, or any combination thereof. When the fluid sensor 54 does not detect cleaning fluid in the recirculation path 38, signals from the temperature sensor 52 may be disregarded or ignored by the docking station 14.

Optionally, the refilling system can include an anti-backflow device 56 in the recirculation path 38. The anti-backflow device 56 provides unidirectional flow of fluid through the path 38, i.e., preventing backflow into the robot supply tank 18. Aside from this function, the anti-backflow device 56 is not particularly limited, and may comprise any components and/or configurations suitable for use in/as an anti-backflow device. The anti-backflow device 56 can, for example, comprise a one-way check valve configured for unidirectional flow into or through the path 38 (e.g., in one direction from the supply tank 18 to the recirculation chamber 34). In some aspects, when present, the anti-backflow device 56 may inhibit backward flow of liquid from the recirculation chamber 34 in the event of the pump 30 being deactivated when cleaning fluid in the chamber 34 is at or above the second inlet 45. This may inhibit and/or minimize leakage of cleaning fluid from the docking station 14.

The storage tank 24 can have an outlet valve 58 to stop the flow of cleaning fluid out of the storage tank 24 when the robot 12 is not docked with the docking station 14 and/or when the docking station 14 is not refilling the robot 12. The valve 58 can be configured to open automatically when the robot 12 requires refilling. In one example, the valve 58 can be a pressure-operated valve that opens via pressurization of the system by the pump 30 and closes when the system is not pressurized. In another example, the valve 58 can be an electromechanically operated solenoid valve that opens by an electric current through a solenoid.

The capacity of the storage tank 24 may be sufficient to refill the robot's supply tank 18 at least once, and preferably multiple times. The storage tank 24 can be removable from the docking station 14 for refilling the tank 24 with cleaning fluid or may have an access opening for refilling the storage tank 24 on the docking station 14. In another embodiment, the storage tank 24 can be a consumable storage tank. The storage tank can comprise a disposable container holding a supply of cleaning fluid. When the supply of cleaning fluid is depleted, the disposable container is removed from the docking station 14 for disposal, and a new disposable container is installed.

The discharge and recirculation paths 28, 38 can be formed, at least in part, by fluid conduits conveying cleaning fluid between fluidly-connected components of the refilling system. The fluid conduits can comprise flexible tubing, such as, but not limited to, flexible silicone, polyurethane, or polyvinyl chloride tubing.

Upon activating the pump 30 and pressurization of the system, cleaning fluid flows from the storage tank 24, through the recirculation chamber 34, pump 30, and heater 32, and into the robot's supply tank 18. Air within the supply tank 18 is compressed and displaced by the cleaning fluid, and flows from the supply tank 18 into the recirculation chamber 34 through the recirculation path 38. Depending on the liquid level in the supply tank 18, only air may circulated back the docking station 14 initially. Once the liquid level in the supply tank 18 reaches a predetermined level, cleaning fluid begins to flow the supply tank 18 into the recirculation chamber 34 through the recirculation path 38.

In some embodiments, a refilling operation can be run at a predetermined time interval during a wet cleaning operation by the robot 12. For example, the supply tank 18 may be replenished with heated cleaning fluid at least once, and optionally multiple times, during a wet cleaning operation. The time interval may, for example, be based on a time interval at which the temperature of cleaning fluid in the supply tank 18 is expected to fall below a predetermined temperature.

In some embodiments, a refilling operation can be run based on the temperature of cleaning fluid in the supply tank 18 of the robot 12. For example, the supply tank 18 may be replenished with heated cleaning fluid when the sensed temperature of cleaning fluid in the supply tank 18 falls below a predetermined temperature.

Figure 2:
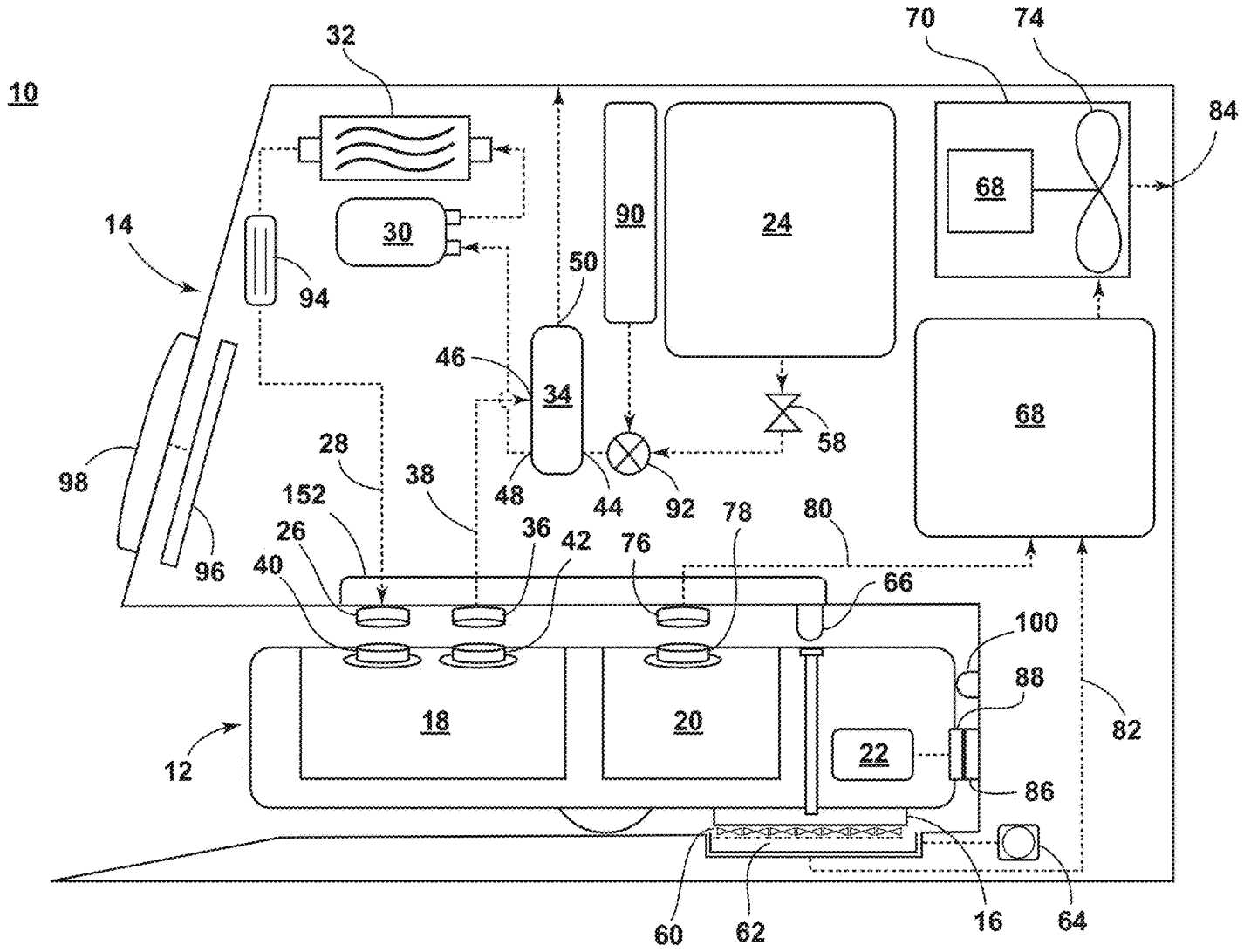
FIG. 2 is a schematic view of a floor cleaning system according to another aspect of the disclosure, the system including at least a floor cleaner and a docking station.

FIG. 2 is a schematic view of an autonomous floor cleaning system 10 according to another aspect of the disclosure. The system 10 may be substantially similar to the system 10 described for FIG. 1, and like elements are referred to with the same reference numerals. In FIG. 2, additional features, systems, and components of the docking station 14 are shown. However, it is understood that the docking station 14 may have more or fewer features, systems, and/or components than those shown in FIG. 2. As but one example, while some components of the refilling system described for FIG. 1 are not shown in FIG. 2, such components of the refilling system may be present, including, but not limited to, the temperature sensor 52, the flow sensor 54, and the anti-backflow device 56.

In one aspect of the disclosure, the docking station 14 can include a pad cleaning system to clean at least one mopping pad 16 on the robot 12 when docked. The pad cleaner can include at least one scrubbing feature for physically scrubbing or agitating the mopping pad 16 on the robot 12. As shown in FIG. 2, the docking station 14 can comprise a scrubber 60 in a position to engage the mopping pad 16 on the underside of the robot 12 when the robot 12 is docked with the docking station 14.

The mopping pad 16 can comprise one or more agitation or cleaning elements configured to mop the surface to be cleaned. Some non-limiting examples of the mopping pad 16 are a microfiber pad or a wet scrubbing pad. The mopping pad 16 can work by absorbing water, debris, and organic matter into the fibers of the cleaning elements. The pad 16 therefore becomes wet and dirty during a cleaning operation performed by the robot 12.

In one non-limiting example, the scrubber 60 can comprise a platform or other surface with a plurality of raised elements, such as nodules, nubs, bristles, paddles, blades, textured pattern, and the like, on a nominal supporting surface or base. The size, shape, density, and distribution of the raised elements provides a highly favorable texture for scrubbing the mopping pad 16. Rotation of the mopping pad 16 over the scrubber 60 exposes the pad material to the raised elements and improves the scrubbing action, resulting in more efficient removal of debris and dirt from the pad 16.

The docking station 14 can include a reservoir 62 that is below the scrubber 60 for collecting the cleaning fluid used to clean the mopping pad 16 and the debris removed from the mopping pad 16. The cleaning fluid may be dispensed from the robot's supply tank 18 in connection with a pad cleaning cycle. The scrubber 60 can define a plurality of drain openings that allow liquid to drain into the reservoir 62. In addition to receiving cleaning fluid dispensed for pad cleaning, the reservoir 62 may retain cleaning fluid that drips off the mopping pad 16 or otherwise from the robot 12 while the robot 12 is docked with the docking station 14.

When the robot 12 is docked at the docking station 14, a pad cleaning cycle can be executed. During the pad cleaning cycle, the robot 12 dispenses cleaning fluid onto the mopping pad 16 while the pad 16 rotates for a period of time to wash the pad 16. The cleaning fluid rinses the mopping pad 16 and collects in the reservoir 62. After a predetermined period of time, such as 1-3 minutes or when it is determined that the pad 16 is sufficiently cleaned, the cleaning cycle may end. Alternatively, the pad 16 can continue to rotate every once-in-a-while to facilitate drying. The docking station 14 may refill the supply tank 18 on the robot 12 during the cleaning cycle in order to replenish the cleaning fluid dispensed for pad cleaning. In some embodiments, a pad cleaning cycle can be run at predetermined intervals during a wet cleaning operation by the robot 12. For example, the mopping pads 16 may be cleaned twice per wet cleaning operation.

As part of pad cleaning, the mopping pad 16 can be dried. In one embodiment, after washing the pad 16, the robot 12 may continue to rotate the pad 16 without dispensing fluid to facilitate drying the pad 16. The pad 16 may be rotated every once-in-a-while or continuously for a period of time to dry the pads 16. In another embodiment, a forced air flow is applied to the pad 16, for example by a separate pad drying fan on the docking station 14. In yet other embodiment, heat can be applied to the pad 16 for drying. To further encourage rapid drying, more than one of the aforementioned active drying processes may be used, e.g., pad rotating, forced air flow, and application of heat, in any combination.

It is noted that, while one pad 16, scrubber 60, and reservoir 62 are shown and referred to herein, it is understood that the robot 12 may have multiple mopping pads 16, and the docking station 14 may have multiple scrubbers 60 and/or reservoirs 62.

In one aspect of the disclosure, the docking station 14 can include a pad removal system for removing the mopping pad 16 from the robot 12. One suitable mechanism is disclosed in U.S. Provisional Patent Application No. 63/290,809, filed Dec. 17, 2021, and which is incorporated herein by reference in its entirety. In one embodiment, the scrubber 60 is formed as a platform that can be raised or lowered relative to the reservoir 62 and a lift mechanism 64 that raises or lowers the platform. In one non-limiting example, the docking station 14 can have a motor-driven lift mechanism 64 to raise and lower the scrubber 60 and force applicator 66 that forces the mopping pad 16 off the robot 12 when the scrubber 60 is raised, for example by pressing on the pad 16 directly or via a force transmitter 67 (e.g., a push rod) coupled with the pad 16. When the scrubber 60 is raised, the scrubber 60 engages the mopping pad 16, and the mopping pad 16 is released from the robot 12, optionally after a pad cleaning cycle to clean the pad 16. The mopping pad 16 is thereby supported on the scrubber 60, and when the scrubber 60 is lowered by the mechanism 64, the mopping pad 16 is also lowered.

Removal of the mopping pad 16 may be performed when switching from wet cleaning to dry cleaning. The docking station 14 can store the removed mopping pad 16 after the robot 12 leaves the docking station 14 to perform dry cleaning. When the robot 12 switches from dry cleaning to wet cleaning, the robot 12 can return to the docking station 14, and the docking station 14 can reinstall the mopping pad 16 on the robot 12.

In one aspect of the disclosure, the docking station 14 can include an evacuation system for emptying the collection bin 20 on the robot 12. In one embodiment, the evacuation system includes a collection tank 68 configured to hold debris emptied from the robot 12 and a suction source 70 that provides suction for the evacuation system to draw debris from the collection bin 20 into the collection tank 68. The suction source 70 can include a vacuum motor 72 and a fan 74, and can define a portion of the evacuation path downstream of the collection tank 68. A filter (not shown) may be disposed at an intake of the suction source 70. The evacuation system can be adapted to handle dry and/or wet debris.

The evacuation system can include an evacuation port 76 on the docking station 14 positioned to couple with a bin port 78 on the collection bin 20, and an evacuation path 80, which can comprise at least one conduit or other structure for conveying debris from the evacuation port 76 to the collection tank 68. Optionally, the collection tank 68 can be lined with a plastic bag that is removed and disposed of when full.

When the robot 12 docks with the docking station 14, a flow connection is established between the evacuation port 76 and the bin port 78. This connection can be made automatically, e.g. without user intervention. In some embodiments, the connection may be passively made between the docking station 14 and robot 12, such as during the driving action of the robot 12 onto the docking station 14. In other embodiments, the connection may be actively made, such by using motors, solenoids, and the like, to move one or both of the ports 76, 78 into engagement. The docking station 14 can include features that assist in alignment of the bin port 78 to the evacuation port 76, either through mechanical or electrical means.

It is noted that, for the robot 12 shown in FIG. 2, the supply tank 18 and collection bin 20 are both present on the robot 12. In other embodiments, the robot may have has interchangeable modules for dry and wet cleaning, such that only the supply tank 18 or only collection bin 20 is present at a time on the robot 12. Operation of the refilling and evacuation systems may be the same for either robot configuration.

The evacuation system can also empty the reservoir 62 used for pad cleaning. The evacuation system can include a second evacuation path 82 on the docking station 14 in fluid communication with the reservoir 62 at an inlet end thereof and with the suction source 70 at an outlet end thereof. The evacuation path 82, which can comprise at least one conduit or other structure for conveying liquid and/or debris from the reservoir 62 to the collection tank 68, or to a separate collection tank (not shown).

The suction source 70 is fluidly coupled to both paths 80, 82, and is configured to generate a first working fluid stream to empty the robot's collection bin 20 and a second working fluid stream to empty the pad cleaning reservoir 62. The working fluid streams may merge at or within the collection tank 68, fluidly upstream of the suction source 70, and be exhausted through a common air outlet 84 of the docking station 14. The capacity of the collection tank 68 may be sufficient to empty the robot's collection bin 20 and the reservoir 62 at least once, and preferably multiple times.

In one aspect of the disclosure, the docking station 14 can recharge the battery 22 of the robot 12. Electrical contacts or charging contacts 86 of the docking station 14 are adapted to mate with the charging contacts 88 on the robot 12 to charge its battery 22. In one example, the docking station 14 can be connected to a household power supply, such as an A/C power outlet, and can include a converter for converting the AC voltage into DC voltage for recharging the power supply on-board the robot 12.

The ports 26, 36, 76, reservoir 62, and/or charging contacts 86 can have a spatial arrangement such that electrical and/or fluid connections are made automatically upon the docking of the robot 12 with the docking station 14. Preferably, the autonomous action of docking the robot 12 with the docking station 14 automatically mates the charging contacts 86, 88, automatically aligns the mopping pads 16 with the reservoir 62 and the force applicator 66, automatically fluidly couples the supply tank 18 with the refilling system, automatically fluidly couples the collection bin 20 with the evacuation system, or any combination thereof.

In one aspect of the disclosure, the refilling system may include, in addition to the components described for FIG. 1, automatic formula dosing. The docking station 14 can include a dosing system to mix a second cleaning fluid with the cleaning fluid from the storage tank 24. The dosing system is preferably incorporated with the refilling system to control the composition of cleaning fluid that is delivered to the robot 12. The composition of the cleaning fluid supplied to the robot 12 can be determined by the ratio of cleaning fluids mixed together by the dosing system.

In one non-limiting example, the dosing system includes a second storage tank 90 and a mixing valve 92 fluidly coupled with an outlet of the second storage tank 90, whereby when mixing valve 92 is open, the second cleaning fluid will mix with the first cleaning fluid flowing out of the storage tank 24. The tank outlet valve 58, when open, releases the first cleaning fluid to the mixing valve 92, and by controlling the time that the mixing valve 92 is open, the addition of the second cleaning fluid can be controlled. Other dosing systems are possible, such as dosing systems with manifolds and controllable orifices.

The storage tanks 24, 90 preferably store different cleaning fluids. For example, the first storage tank 24 can store water and the second storage tank 90 can store a cleaning formula, such as detergent.

The storage tank tanks 24, 90 can be removable from the docking station 14 for refilling, or can have fill openings to be refillable on the docking station 14. In another embodiment, one or both of the tanks 24, 90 comprise a disposable container holding a supply of cleaning fluid. When the supply of cleaning fluid is depleted, the disposable container is removed from the docking station 14 for disposal, and a new disposable container is installed. In still other embodiments, the tanks 24, 90 can be nested with each other or integrally formed with each other, such as by a single container defining multiple chambers for different cleaning fluids.

In one aspect of the disclosure, the refilling system may include, in addition to the components described for FIG. 1, a deionization module 94 disposed in the discharge path 28 between the storage tank 24 and the supply port 26. The deionization module 94 is configured to remove ions from the cleaning fluid using an ion exchange process. In one embodiment, the deionization module 94 can be disposed downstream of the heater 32 and upstream of the supply port 26.

The docking station 14 may include a controller 96 is operably coupled with the various functional systems of the docking station 14 for controlling its operation. The controller 96 can be a microcontroller unit (MCU) that contains at least one central processing unit (CPU). The docking station 14 can include various sensors (e.g., temperature sensor 52 of FIG. 1) and emitters for monitoring a status of the robot 12, enabling auto-docking functionality, enabling robot-servicing functionality, and communicating with the robot 12, as well as features for network and/or Bluetooth connectivity.

The controller 96 is further operably coupled with a user interface (UI) 98 on the docking station 14 for receiving inputs from a user. The UI 98 can have a display, such as an LED display, for providing visual notifications to the user, and a speaker for providing audible notifications to the user.

The mating between the electrical contacts 88 on the robot 12 and the electrical contacts 86 on the docking station 14 can enable communication between the control system on the robot 12 and the controller 96. In other examples, the communication between the robot 12 and the docking station 14 is provided over an infrared (IR), network, or Bluetooth communication link. In still other embodiments of the docking station 14, additional contacts may be used to transmit data and information between the robot 12 and docking station 14.

The docking station 14 can have an automatic coupling mechanism for establishing a supply and recirculation connection between the refilling system and the robot 12. The automatic coupling mechanism provides accurate coupling between the supply ports 26, 40 and the recirculation ports 36, 42. This can prevent misalignment and leaks when the robot 12 is docked at the docking station for refilling.

In one embodiment, the automatic alignment and coupling mechanism can comprise an indexer 152 carrying the supply port 26 and the recirculation port 36, the indexer 152 configured to move the ports 26, 36 into engagement with the corresponding ports 40, 42 on the robot 12 to fluidly couple the refilling system with the robot 12. The indexer 152 is also configured to move the ports 26, 36 out of engagement with the corresponding ports 40, 42 on the robot 12 to fluidly decouple or disconnect the refilling system with the robot 12.

The indexer 152 may carry the force applicator 66, such that the movement of indexer 152 to make the supply and recirculation connection also brings the force applicator 66 into engagement with the mopping pad 16 on the robot 12 to force the mopping pad 16 off the robot 12. In other embodiments, the pad removal is performed independently of the supply and recirculation connection.

The indexer 152 may carry the evacuation port 76, such that the movement of indexer 152 to make the supply and recirculation connection also brings the evacuation port 76 into engagement with the bin port 78 on the robot 12 to fluidly couple the evacuation system with the robot 12 In other embodiments, the connection between ports 76, 78 is made independently of the supply and recirculation connection.

In one embodiment, the indexer 152 comprises an indexable bracket that can move relative to the robot 12 when the robot 12 is docked at the docking station 14. For example, the indexable bracket 152 may be in a first position (e.g., a raised position) when the robot 12 initially docks, and then may move (e.g., lower) to a second position (e.g., a lowered position) to establish one or more connections between the docking station 14 and robot 12.

The controller 96 can comprise logic control electronics for controlling the operation of the automatic coupling mechanism. For example, the controller 96 may also receive input regarding the state of the storage tank 24, for example whether it is full, empty, present on the docking station 14, or absent from the docking station 14, and can move or not move the indexer 152 accordingly. Other input that the controller 96 may use to control the automatic coupling mechanism can include, but is not limited to, the state of the supply tank 18, for example whether it is full, empty, present on the robot 12, or absent from the robot 12. Yet other input that the controller 96 may use to control the automatic coupling mechanism can include, but is not limited to, the temperature of liquid within the supply tank 18, for example whether the temperature is at, below, or above a predetermined threshold temperature. Still other input that the controller 96 may use to control the automatic coupling mechanism can include, but is not limited to, the state of the mopping pad 16, the state of the collection tank 68, and/or the state of the collection bin 20.

When the robot 12 is docked at the docking station 14, a robot servicing function can be executed by either, or a combination of, a controller of the robot 12 or the controller 96 on the docking station 14. For example, when the robot 12 is properly docked, the docking station 14 can issue a command to the robot 12 to execute refilling the supply tank 18, execute a pad cleaning, execute pad removal, execute pad installation, execute evacuation of the bin 20 and reservoir 62, execute recharging the battery 22, and the like, or any combination thereof. In some examples, the controller 96 sends a communication to the robot 12 and will only initiate a robot servicing function if the controller 96 receives a response to this communication from the robot 12. In other examples, when the robot 12 is properly docked, the robot 12 can issue a command to the docking station 14 to initiate a robot servicing function. The robot 12 can transmit the command to the docking station 14 through electrical signals, optical signals, or other appropriate signals.

In one embodiment, the docking station 14 may automatically execute a servicing function. In another embodiment, the docking station 14 can execute a servicing function when the docking station 14 receives a manual input from a user. In some embodiments, to execute a servicing function can be manually initiated. For example, input controls to select, pause, and/or stop a servicing function can be provided on the UI 98, the robot 12, and/or on a smart device application executed on a mobile or remote device. For some embodiments of the system 10, a combination of automatic and manual initiation options for a serving function may be provided.

In some embodiments, the robot 12 can determine that servicing is required, and then return to the docking station 14 to be serviced. This can prevent the robot 12 from continuing to clean when the supply tank 18 is empty or near-empty, when the temperature of cleaning fluid in the supply tank 18 is at or below a minimum temperature threshold, when the collection bin 20 is full or near-full, when the mopping pads 16 are too dirty to be effective, or when the battery 22 is low. Input from sensors on the robot 12 may be used to determine that servicing is required, and to return the robot 12 to the docking station 14 for servicing. In another embodiment, the robot 12 returns to the docking station 14 for servicing after a predetermined operating time has been surpassed.

In some embodiments, at least one, and optionally multiple, servicing function can be initiated each time the robot 12 docks with the docking station 14. An activating switch 100 for controlling at least one servicing function can be provided and can be operable to move between an on and off position. When the activating switch 100 is "on", the servicing function begins. The activating switch 100 is configured to be actuated (i.e., moved to the on position) when the robot 12 docks with the docking station 14. In one embodiment, the activating switch 100 can comprise an optical switch on the docking station 14 that is occluded by the robot 12 to indicate that the robot 12 is present.

In some embodiments, an override control can be provided on the robot 12, the docking station 14, and/or on a smart device application executed on a mobile or remote device for stopping or pausing a servicing function.

Figure 3:
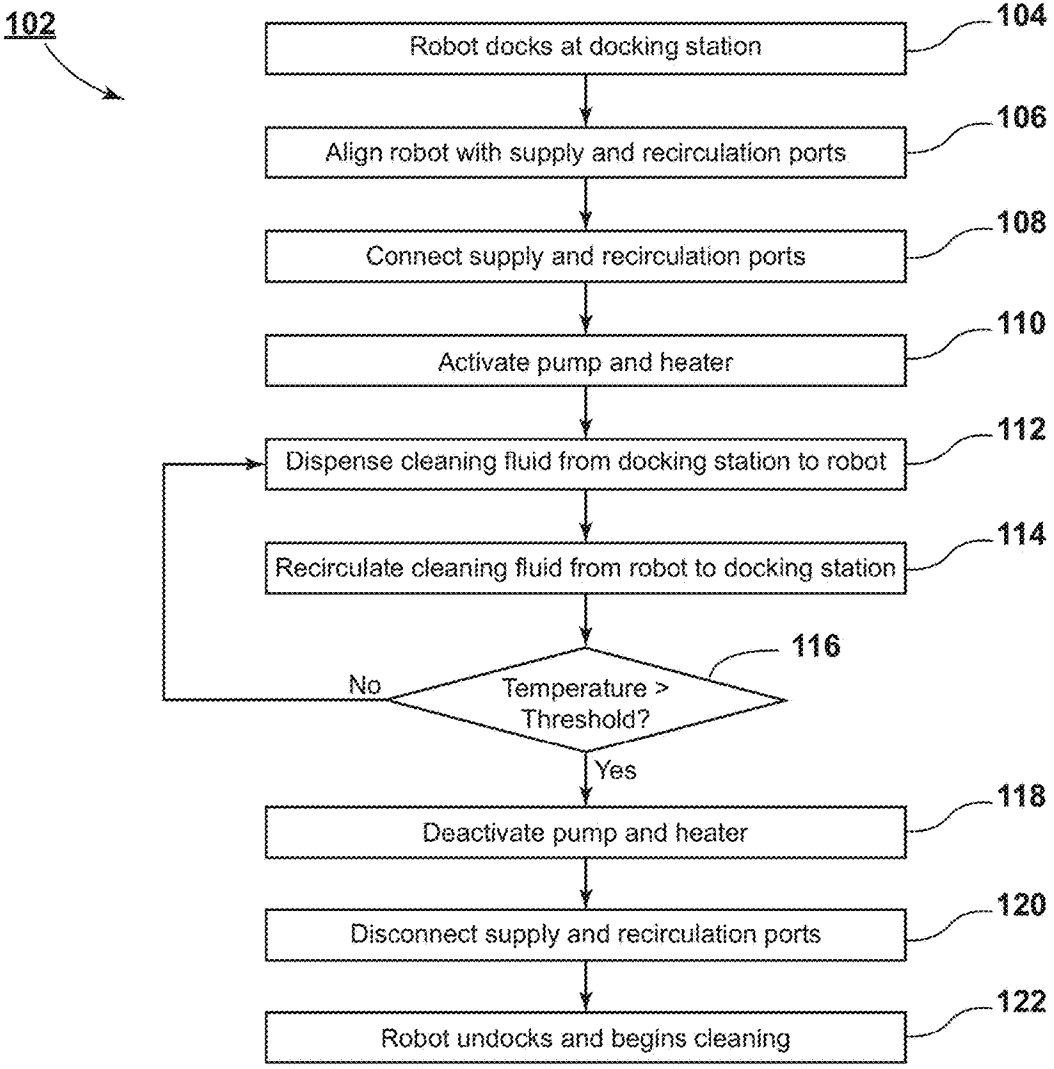
FIG. 3 is a flow chart showing a method for refilling a floor cleaner at a docking station.

FIG. 3 is a flow chart showing a method 102 for refilling a floor cleaner at a docking station. The method may be executed using, but is not limited to, any docking station and/or robot disclosed herein. For purposes of description, reference numerals present in FIG. 1-2 are referred to for the method 102. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

At step 104, the robot 12 docks with the docking station 14. To dock, the robot 12 drives to the docking station, for example using one or more docking signals emitted from the docking station 14 and received by the robot 12.

Docking can be initiated by a return-to-dock event, some non-limiting examples of which include when the supply tank 18 requires filling, when the temperature of cleaning fluid in the supply tank 18 is at or below a minimum temperature threshold, or when a predetermined operating time has elapsed. The predetermined operating time can, for example, be based on a time interval at which the temperature of cleaning fluid in the supply tank 18 is expected to fall below a predetermined temperature. Other return-to-dock events may include when the collection bin 20 requires emptying, when switching between cleaning modes, when the pads 16 require cleaning, when the battery 22 requires charging, when cleaning is complete, when a user manually initiates a return-to-dock event, or any combination thereof.

At step 106, the robot 12 aligns with the supply port 26 and recirculation port 36 on the docking station 14. During this alignment, the robot 12 may simultaneously align with the reservoir 62. The docking station 14 may include can include features that assist in alignment of the robot 12, either through mechanical or electrical means.

At step 108, the ports are connected to establish a fluid communication between the robot 12 and docking station 14. During this connection, the supply tank 24 on the docking station 14 is fluidly coupled with the first port 40 on the supply tank 18 and the recirculation port 36 on the docking station 14 is fluidly coupled with the second port 42 on the supply tank 18. To connect the ports, the docking station 14 may move or lower the indexer 152. Connection of the ports may include opening one or more port valves.

At step 110, the pump 30 and heater 32 are activated. The pump 30 and heater 32 may be activated simultaneously or sequentially. In one embodiment, the heater 32 is activated first to begin heating up before cleaning fluid starts to flow through the system, and the pump 30 is subsequently activated after the heater 32 is pre-heated.

At step 112, cleaning fluid is dispensed from the docking station 14 to the supply tank 18. Optionally during step 112, the dosing system may mix cleaning fluid from the second storage tank 90 in with the cleaning fluid flowing out of the storage tank 24, and/or the deionization module 94 may remove ions from the cleaning fluid.

At step 114, cleaning fluid is recirculated from the supply tank 18 to the docking station 14. This may include, but is not limited to, conveying cleaning fluid from the recirculation port 36 to the recirculation chamber 34.

At step 116, the docking station 14 and/or the robot 12 can determine whether the temperature T of cleaning fluid in the supply tank 18 exceeds a predetermined threshold temperature T1. This may include, but is not limited to, measuring the temperature of cleaning fluid recirculating from the supply tank 18 to the docking station 14 with temperature sensor 52 and comparing the measured temperature to the predetermined threshold temperature. This may include, but is not limited to, measuring the temperature after the flow sensor 54 determines that cleaning fluid, e.g. not air, is flowing from the supply tank 18 to the docking station 14.

If the temperature measured at step 116 is at or below the predetermined temperature threshold, the docking station 14 continues to refill the supply tank 18, e.g. returns to step 112.

If the temperature measured at step 116 exceeds the predetermined temperature threshold, the docking station 14 stops refilling the supply tank 18. This may include, but is not limited to, deactivating the pump 30 and heater 32 at step 118 and uncoupling the supply ports 26, 40 and recirculation ports 36, 42 at step 120.

Optionally, at step 118 or 120, the robot 12, the docking station 14, and/or a smart device application executed on a mobile or remote device can alert the user that the supply tank 18 has been refilled, alternatively that the supply tank 18 has been refilled with heated cleaning fluid, such as by providing a visual and/or audible user notification.

At step 122, the robot 12 undocks, e.g. leaves the docking station 14, and may begin a cleaning operation. Optionally, at step 122, the robot 12, the docking station 14, and/or a smart device application executed on a mobile or remote device can alert the user that the robot 12 has undocked and/or that cleaning has begun, such as by providing a visual and/or audible user notification.

Figure 4:
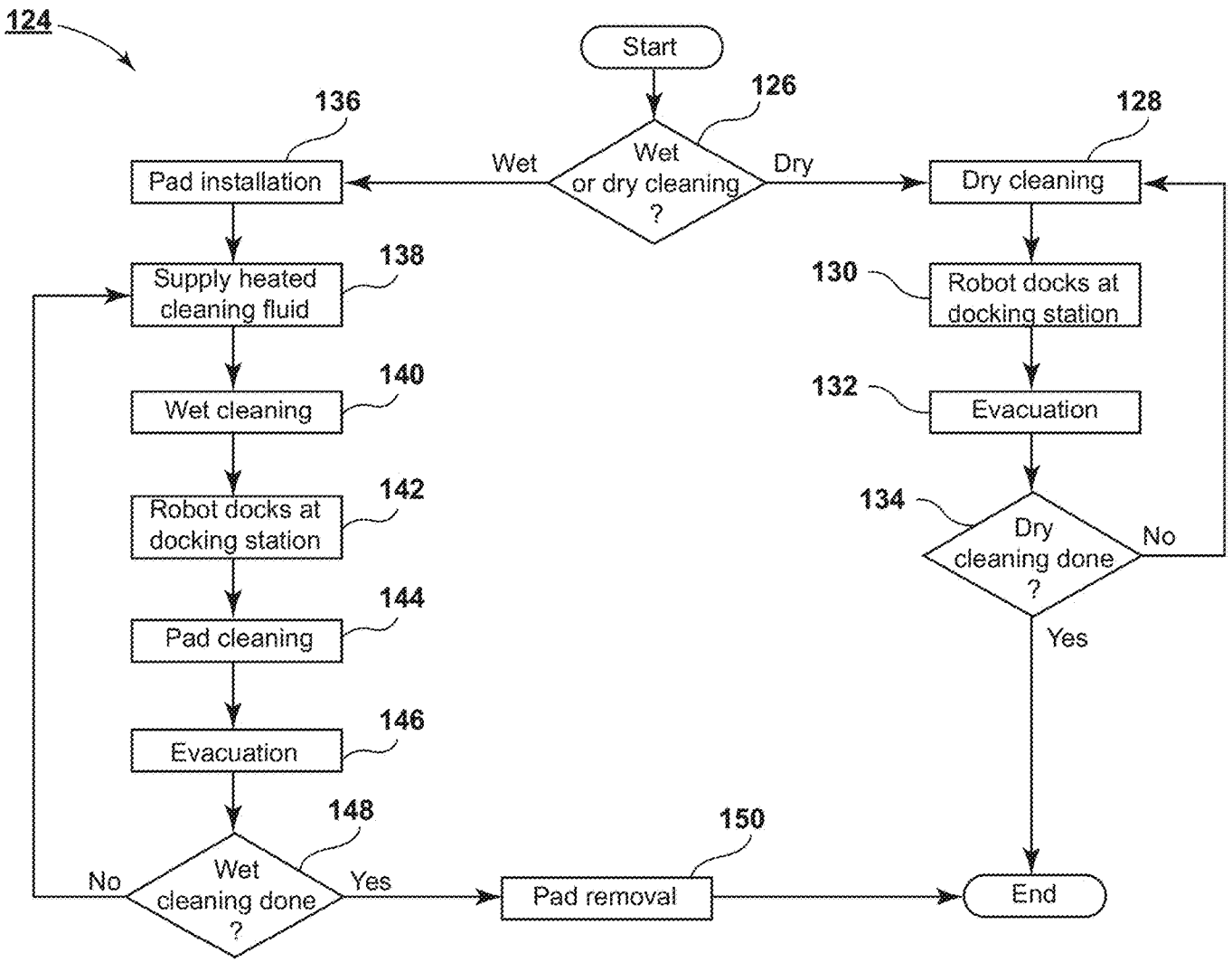
FIG. 4 is a flow chart showing a method for operating and servicing an autonomous floor cleaner.

FIG. 4 is a flow chart showing a method 124 for operating and servicing an autonomous floor cleaner. The method may be executed using, but is not limited to, any docking station and/or robot disclosed herein. For purposes of description, reference numerals present in FIG. 1-2 are referred to for the method 124. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

At step 126, a wet cleaning operation or a dry cleaning operation is initiated. Initiation of a cleaning operation by the robot 12 can be based on a predetermined cleaning schedule, a user input at the robot 12, a user input at the docking station 14, or a user input via a personal communication device in communication with the robot 12 and/or the docking station 14. The personal communication device can include, but is not limited to, a mobile communication device such as a smart phone or tablet, a personal computer such as a laptop, or a voice-controlled remote device such as an Amazon Echo® or Amazon Echo Dot® having the Amazon Alexa® cloud-based voice service, or a Google Home® or Google Home Mini® having Google Assistant. For example, a user with a smart speaker device can speak an instruction, such as "Alexa, ask [robot] to start wet cleaning," or "Alexa, ask [robot] to start dry cleaning," and via the Wi-Fi and/or Internet connectivity, the robot 12 can begin the requested cleaning cycle of operation. As another example, via a smart device application that is executed on the personal communication device, the user can instruct the robot 12 to perform wet cleaning or dry cleaning.

If dry cleaning is selected at step 126, the robot 12 begins a dry cleaning operation at step 128. Step 204 may include undocking the robot 12 from the docking station 14. The dry cleaning operation may include collecting debris in collection bin 20. The dry cleaning operation may further include, but is not limited to, autonomously driving the robot 12 over the surface to be cleaned, activating a suction source of the robot 12, rotating a brushroll, edge brush, or other agitator of the robot 12, or any combination thereof, and in any order.

At step 130, the robot 12 docks with the docking station 14. To dock, the robot 12 drives to the docking station, for example using one or more docking signals emitted from the docking station 14 and received by the robot 12. The docking station 14 may include can include features that assist in alignment of the robot 12, either through mechanical or electrical means.

Docking can be initiated by a return-to-dock event, some non-limiting examples of which include when a predetermined operating time has elapsed, when the supply tank 18 requires filling, when the temperature of cleaning fluid in the supply tank 18 is at or below a minimum temperature threshold, when the collection bin 20 requires emptying, when the pads 16 require cleaning, when the battery 22 requires charging, when switching between cleaning modes, when cleaning is complete, when a user manually initiates a return-to-dock event, or any combination thereof.

At step 132, the collection bin 20 is evacuated to empty debris therefrom. This may include, but is not limited to, coupling evacuation port 76 with bin port 78, activation of the vacuum motor 72, and conveying debris from the evacuation port 76 to the collection tank 68.

At step 134, the robot 12 and/or the docking station 14 can determine whether the dry cleaning operation is complete. If the dry cleaning operation is not complete, the robot undocks and resumes the dry cleaning operation, e.g. returns to step 128. Steps 128-134 may be repeated at least once, and optionally may be repeated more than once, until the dry cleaning operation is complete. Once the dry cleaning operation is complete as determined at step 134, the method ends. The robot 12 may remain at the docking station 14 for recharging and/or storage.

If wet cleaning is selected at step 126, the robot 12 is prepared for wet cleaning. This may include one or both of installing the mopping pad 16 at step 136 and supplying heated cleaning fluid to the robot 12 at step 138. Heated cleaning fluid may be supplied to the robot 12 according to one or more of steps 106-120 for method 102 (FIG. 4).

The robot begins a wet cleaning operation at step 140. Step 140 may include undocking the robot 12 from the docking station 14. The wet cleaning operation may include dispensing cleaning fluid from the supply tank 18, mopping the surface to be cleaned to collect liquid and debris on the mopping pad 16, and collecting debris in collection bin 20. The wet cleaning operation may further include, but is not limited to, autonomously driving the robot 12 over the surface to be cleaned, opening a fluid control valve of the robot 12, activating a pump of the robot 12, activating a suction source of the robot 12, rotating a brushroll, edge brush, or other agitator of the robot 12, or any combination thereof, and in any order.

At step 142, the robot 12 docks with the docking station 14. The robot 12 docks with the docking station 14 upon a return-to-dock event, some non-limiting examples of which are listed above for step 130.

At step 144, the mopping pad 16 is cleaned. A pad cleaning cycle can be executed by the controller 96 of the docking station 14 and/or the controller of the robot 12. Initiating the cleaning cycle at step 144 can power one or more components of the robot 12 or the docking station. For example, at step 144, the lift mechanism 64 can raise the scrubber 60, a motor of the robot 12 can be powered to rotate the mopping pad 16 to scrub the pad 16 against the scrubber 60, and a flow controller of the robot 12, such as a pump or valve, can be powered to dispense cleaning fluid to the mopping pad, or any combination thereof, and in any order.

At step 146, the collection bin 20 and the pad cleaning reservoir 62 are evacuated to empty debris and/or liquid therefrom. This may include, but is not limited to, coupling evacuation port 76 with bin port 78, activation of the vacuum motor 72, conveying debris from the evacuation port 76 to the collection tank 68, and conveying dirty cleaning fluid from the reservoir 62 to the collection tank 68.

At step 148, the robot 12 and/or the docking station 14 can determine whether the wet cleaning operation is complete. If the wet cleaning operation is not complete, heated cleaning fluid is supplied to the robot 12, e.g., the method returns to step 138, and then the robot 12 resumes the wet cleaning operation at step 140. Steps 138-148 may be repeated at least once, and optionally may be repeated more than once, until the wet cleaning operation is complete.

Once the wet cleaning operation is complete as determined at step 148, the mopping pad 16 is removed at step 150. A pad removal operation can be executed by the controller 96 of the docking station 14. Pad removal at step 150 can include powering one or more components of the docking station 14. For example, at step 150 the force applicator 66 can lower to release the mopping pad 16 from the robot 12 and the lift mechanism 64 can lower the released mopping pad 16 away from the robot 12 on the scrubber 60. Optionally, at step 150, the robot 12, the docking station 14, and/or a smart device application executed on a mobile or remote device can alert the user that the mopping pad 16 have has removed, such as by providing a visual and/or audible user notification. After pad removal, the method ends. The robot 12 may remain at the docking station 14 for recharging and/or storage.

It is noted that the method 124 can include recharging the battery 22 of the robot 12. When the robot 12 docks with the docking station, for example at step 130 or step 142, the docking station 14 can begin recharging the battery 22. A cleaning operation may not start or resume, e.g., at steps 128 or 140, until the battery 22 is sufficiently charged.

Figure 5:
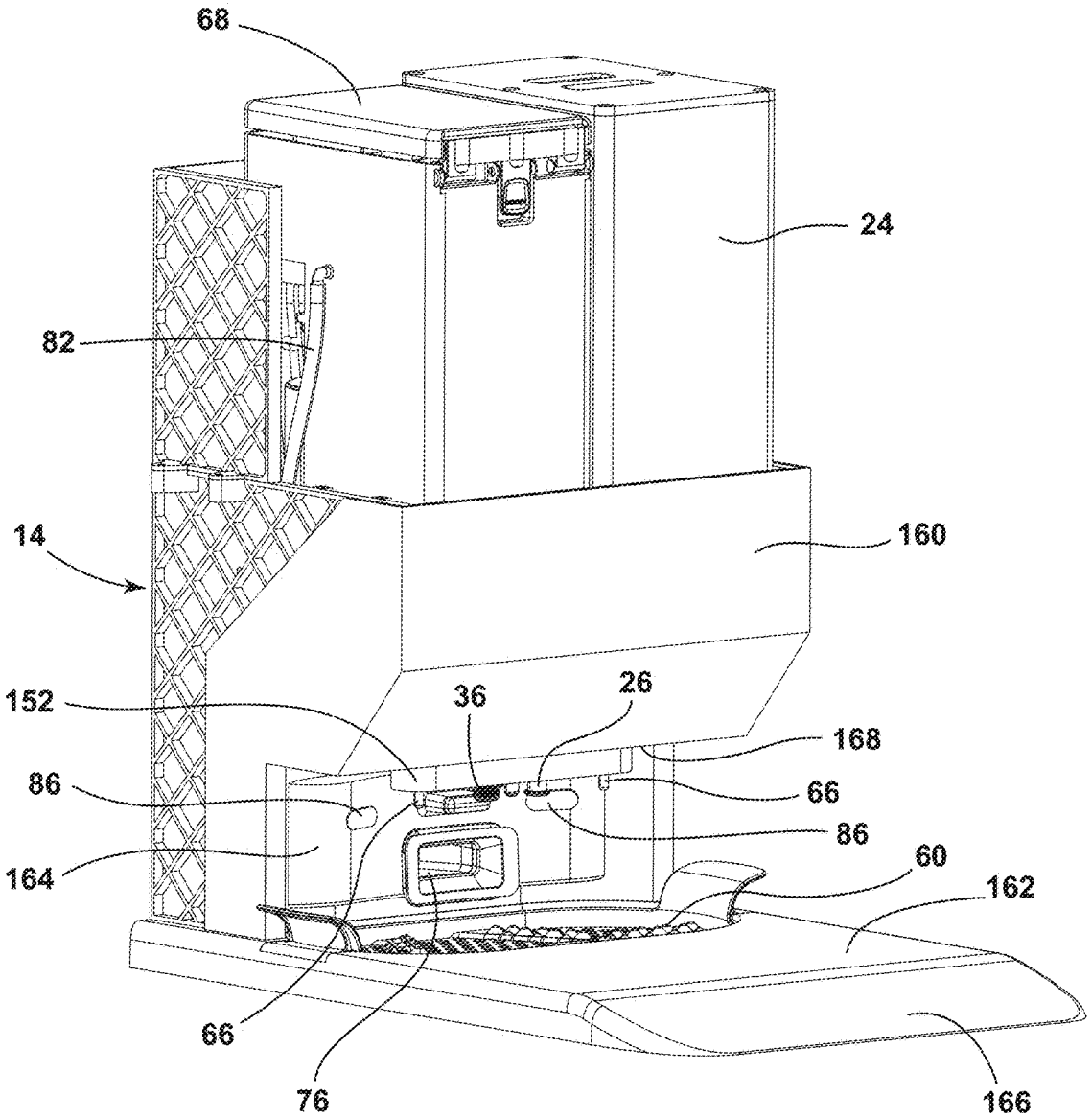
FIG. 5 is a perspective view of a docking station that can embody one or more of the systems described in FIG. 2.

FIG. 5 is a perspective view of one embodiment of a docking station 14 that can embody one or more of the systems described in FIG. 2. The docking station 14 provides support for the robot 12 (not shown in FIG. 5) to service the robot 12 and to store the robot 12 when not in use.

The docking station 14 includes a housing 160 that at least partially supports the robot 12 while servicing and storing the robot 12, and the housing 160 can include a base or platform 162 and a backstop 164. The platform 162 can extend generally horizontally to be disposed on a floor surface. The backstop 164 is generally perpendicular to the floor surface on which the platform 162 rests. Aside from the backstop 164, the sides of the platform 162 may be open. In other embodiments, the housing 160 can have a substantially enclosed space configuration to receive the robot 12, with the robot 12 entering or exiting the enclosed space through an opening in the housing 160. Other shapes and configurations for the housing 160 are possible.

The platform 162 can as large as, or larger than, the footprint of the robot 12, so that the robot 12 rests entirely on the platform 162 when docked. This elevates the robot 12 off the floor and can protect the floor from damage, particularly if components of the robot 12 remain wet after use. As depicted, the platform 162 includes a ramp 166 to enable the robot 12 to drive up and onto the platform. The ramp 166 also permits the robot 12 to be further elevated off the floor than a platform 162 on its own. The ramp 166 may comprise a forward edge of the platform 162 that slopes downwardly.

The housing 160 comprises a ceiling 168 above the platform 162, and in some embodiments in front of the backstop 164 and/or below the tanks 24, 68. The ceiling 168 can overhang at least a portion of the robot 12 when docked.

The storage tank 24 and collection tank 68 can be disposed on the housing 160, for example in receiving space disposed above the backstop 164, behind the backstop 164, and/or above the ceiling 168. The tanks 24, 68 may be fillable or emptiable by any means known in the art, including, but not limited to, being removable from the housing 160.

The supply port 26 can be provided on the ceiling 168, or may be disposed anywhere on the housing 160 in a location to couple with the supply port 40 (FIG. 2) of the robot 12.

The recirculation port 36 can be provided on the ceiling 168, or may be disposed anywhere on the housing 160 in a location to couple with the recirculation port 42 (FIG. 2) of the robot 12.

The force applicator 66 can be provided on the ceiling 168, or may be disposed anywhere on the housing 160 in a location to release the mopping pad 16 from the robot 12.

The indexer 152 can carry the supply port 26, recirculation port 36, and force applicator 66, and can be disposed on the housing 160 to move up and down relative to the ceiling 168.

The scrubber 60 can be provided on the platform 162 in front of the backstop 164, or may be disposed anywhere on the platform 162 in a location to engage the mopping pad 16 (FIG. 2) on the underside of the robot 12.

The evacuation port 76 may be disposed on backstop 164, or may be disposed anywhere on the housing 160 in a location to couple with the bin port 78 (FIG. 2) of the robot 12.

The charging contacts 86 may be disposed on backstop 164, or may be disposed anywhere on the housing 160 in a location to couple with the charging contacts 88 (FIG. 2) of the robot 12.

To the extent not already described, the different features and structures of the various embodiments of the invention, may be used in combination with each other as desired, or may be used separately. That one autonomous floor cleaning system, robot, or docking station is illustrated herein as having the described features does not mean that all of these features must be used in combination, but rather done so here for brevity of description. Any of the disclosed docking stations may be provided independently of any of the disclosed robots, and vice versa. Further, while multiple methods are disclosed herein, one of the disclosed methods may be performed independently, or more than one of the disclosed methods, including any combination of methods disclosed herein may be performed by one robot or docking station. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A docking station for an autonomous floor cleaner, the docking station comprising:

a storage tank configured to hold a supply of cleaning fluid;

a dispensing port configured to couple with a first port on the autonomous floor cleaner to refill a supply tank on the autonomous floor cleaner with cleaning fluid from the storage tank;

a discharge path configured to convey cleaning fluid from the storage tank to the dispensing port;

a pump to move cleaning fluid through the discharge path;

a heater to heat cleaning fluid in the discharge path;

a recirculation chamber in the discharge path, the recirculation chamber having an outlet in fluid communication with the discharge path configured to convey cleaning fluid from the storage tank to the dispensing port; and a recirculation port configured to couple with a second port on the autonomous floor cleaner to circulate cleaning fluid from the supply tank on the autonomous floor cleaner to the recirculation chamber.

2. The docking station of claim 1, wherein the recirculation chamber comprises an air escape outlet.

3. The docking station of claim 1, wherein the recirculation chamber comprises a first inlet in fluid communication with the storage tank and a second inlet in fluid communication with the recirculation port.

4. The docking station of claim 3, wherein the second inlet is higher than the first inlet.

5. The docking station of claim 1, comprising a recirculation path configured to convey cleaning fluid from the recirculation port to the recirculation chamber, and at least one of:

a temperature sensor in the recirculation path;

a flow meter in the recirculation path; and an anti-backflow device in the recirculation path.

6. The docking station of claim 1, comprising a temperature sensor configured to sense the temperature of cleaning fluid in the supply tank on the autonomous floor cleaner.

7. The docking station of claim 6, wherein the temperature sensor is configured to sense the temperature of cleaning fluid at one of the recirculation port, the recirculation chamber, and between the recirculation port and the recirculation chamber.

8. The docking station of claim 1, wherein the storage tank comprises an outlet valve controlling the flow of cleaning fluid out of the storage tank.

9. The docking station of claim 1, wherein the dispensing port comprises a valve controlling the flow of cleaning fluid out of the dispensing port.

10. The docking station of claim 1, wherein the recirculation port comprises a valve controlling the flow of cleaning fluid into the recirculation port.

11. The docking station of claim 1, comprising a dosing system to mix a second cleaning fluid with the cleaning fluid from the storage tank, wherein the dosing system comprises a second storage tank.

12. The docking station of claim 11, wherein the dosing system comprises a mixing valve fluidly coupled with an outlet of the second storage tank, whereby opening the mixing valve releases the second cleaning fluid to mix with the cleaning fluid flowing out of the storage tank to the dispensing port.

13. The docking station of claim 1, comprising an evacuation system, the evacuation system comprising;

a collection tank; and an evacuation port configured to couple with an empty port on the autonomous floor cleaner to empty a collection bin on the autonomous floor cleaner.

14. The docking station of claim 13, wherein the evacuation system comprises a suction source to draw debris from the collection bin on the autonomous floor cleaner into the collection tank and at least one evacuation conduit to convey debris from the evacuation port to the collection tank.

15. The docking station of claim 1, comprising a pad cleaning system comprising:

at least one scrubber configured to engage a mopping pad on the autonomous floor cleaner to clean the mopping pad; and a reservoir configured to collect liquid and debris from the mopping pad.

16. The docking station of claim 1, comprising charging contacts configured to contact corresponding charging contacts of the autonomous floor cleaner to charge a battery of the autonomous floor cleaner.

17. A docking station for an autonomous floor cleaner, the docking station comprising:

at least two charging contacts, the at least two charging contacts configured to contact corresponding charging contacts of an autonomous floor cleaner to charge a battery of the autonomous floor cleaner;

a storage tank configured to hold a supply of cleaning fluid;

a discharge path configured to convey cleaning fluid from the storage tank to the autonomous floor cleaner;

a dispensing port configured to couple with a first port on the autonomous floor cleaner to refill a supply tank on the autonomous floor cleaner with cleaning fluid from the storage tank;

a recirculation path configured to convey cleaning fluid from the autonomous floor cleaner to the discharge path;

a recirculation port configured to couple with a second port on the autonomous floor cleaner to circulate cleaning fluid from the supply tank on the autonomous floor cleaner to the recirculation path; and an indexer carrying the dispensing port and the recirculation port, and configured to move the dispensing and recirculation ports into and out of engagement with the autonomous floor cleaner.

18. A method of servicing an autonomous floor cleaner, the method comprising:

docking the autonomous floor cleaner at a docking station, the docking station having a storage tank configured to hold a supply of cleaning fluid, a dispensing port, a heater, and a discharge path configured to convey liquid from the storage tank to the dispensing port;

coupling a supply tank on the autonomous floor cleaner to the dispensing port of the docking station; and exchanging cooled cleaning fluid in the supply tank with heated cleaning fluid from the docking station by recirculating cooled cleaning fluid in the supply tank on the autonomous floor cleaner to the docking station.

19. The method of claim 18, wherein the docking station comprises a recirculation chamber in the discharge path, wherein exchanging cooled cleaning fluid in the supply tank with heated cleaning fluid from the docking station comprises recirculating cooled cleaning fluid in the supply tank on the autonomous floor cleaner to the recirculation chamber.

20. The method of claim 18, wherein the docking station comprises a recirculation chamber in the discharge path, wherein exchanging cooled cleaning fluid in the supply tank with heated cleaning fluid from the docking station comprises heating the cooled cleaning fluid onboard the docking station.

* * * * *